US005735154A

United States Patent [19]

Hein

[11] Patent Number: 5,735,154

[45] Date of Patent: Apr. 7, 1998

[54] METHOD OF CONTROLLING THE PASSAGE OF ROLLING STOCK THROUGH A CONTINUOUS MILL TRAIN

[75] Inventor: Otto Hein, Steyr, Austria

[73] Assignee: GFM GmbH, Steyr, Austria

[21] Appl. No.: 670,940

[22] Filed: Jun. 26, 1996

[30] Foreign Application Priority Data

Jul. 31, 1995 [AT] Austria ..... 1302/95

[51] Int. Cl.[6] ..... B21B 37/74

[52] U.S. Cl. ..... 72/13.4; 72/249

[58] Field of Search ..... 72/249, 8.2, 9.5, 72/10.1, 10.2, 12.1, 13.1, 13.2, 13.4, 14.4, 20.1, 21.4, 17.2, 19.8, 28.1, 28.2; 364/472.07

[56] References Cited

U.S. PATENT DOCUMENTS

| | | | |
|---|---|---|---|
| 3,457,747 | 7/1969 | Yeomans | 72/10.2 |
| 3,962,894 | 6/1976 | Noe et al. | 72/10.2 |
| 4,566,299 | 1/1986 | Koyana et al. | 72/10.2 |
| 5,291,108 | 3/1994 | Gerretz et al. | 72/13.4 |

FOREIGN PATENT DOCUMENTS

| | | | |
|---|---|---|---|
| 356622 | 10/1979 | Austria . | |
| 968271 | 8/1955 | Germany . | |
| 2129082 | 12/1971 | Germany . | |
| 61-193710 | 8/1986 | Japan | 72/249 |
| 0157909 | 3/1989 | Japan | 72/10.1 |
| 0067813 | 1/1994 | Japan | 72/249 |
| 0825212 | 4/1981 | U.S.S.R. | 72/205 |
| 1680397 | 9/1991 | U.S.S.R. | 72/249 |
| 1819167 | 5/1993 | U.S.S.R. | 72/249 |

*Primary Examiner*—Lowell A. Larson
*Assistant Examiner*—Ed Tolan
*Attorney, Agent, or Firm*—Collard & Roe, P.C.

[57] ABSTRACT

A method of controlling the passage of rolling stock through a continuous mill train of successive roll stands comprising rolling shafts supporting the rolls, a rolling-mill drive preceding the rolling shafts, and individual electric motor drives having a steplessly variable rotary speed connected to the rolling-mill drive to apply torque to the rolling shafts, which comprises the steps of (a) measuring a reaction force on a machine part of a respective one of the stands to obtain a physical parameter changing in dependence on the torque before and after an initial pass of a stand succeeding the one stand, and (b) controlling the rotational speed of the individual electric motor drive for the succeeding one stand in dependence on any change of the measured physical parameter.

3 Claims, No Drawings

METHOD OF CONTROLLING THE PASSAGE OF ROLLING STOCK THROUGH A CONTINUOUS MILL TRAIN

This invention relates to a method of controlling the passage of rolling stock through a continuous mill train of successive roll stands comprising rolling shafts supporting the rolls, a rolling-mill drive preceeding the rolling shafts, and an individual drive having a steplessly variable rotary speed and that can be connected to the rolling-mill drive to apply torque to the rolling shafts, behind which a physical parameter changing in dependence on the torque is measured before and after an initial pass of each succeeding stand, and then the rotational speed of the drive for this succeeding stand is controlled in dependence on the change of parameters detected during the initial pass.

Such method is known from the U.S. Pat. No. 4,287,738, and as regards the basic explanations concerning the purpose and meaning of this method, reference is therefore made to the description of this patent. In the known method, hydraulic drives serve as individual drives of the stands, and the hydraulic pressure of these drives is measured as parameter, which after having been changed as a result of the initial pass of the succeeding stand leads to an adjustment of the pump associated to the hydraulic motor, and thus influences the quantity of hydraulic fluid delivered. This method has gained wide acceptance in mill trains including a hydraulic drive, but it cannot be used with the same success in mill trains using electric motors. Due to the great weight of the active iron, an electric drive, in particular a d.c. drive, has a much larger moment of inertia than a hydraulic drive of comparable performance, so that in combination with the considerably higher rotational speeds of the electric motor even small variations of the rotational speed have a noticeable influence on the tolerance compliance, which in the case of electric drives absolutely necessitates a direct control of the rotational speed so as to maintain close tolerances. But since up to now in individual electric motor drives for the roll stands, the armature current is measured as a parameter for the rolling torque, the inertia of the drive inevitably leads to an unsatisfactory inaccuracy as a result of the slow reaction to a change of momentum in the rolling area, and it should be noted in addition that the armature current depends on the torque, but at the same time also on the respective rotational speed, which virtually excludes the maintenance of closer tolerances.

It is therefore the object of the invention to eliminate these deficiencies and to provide a method of the above-stated kind, by means of which a low-tension and lowpressure rolling can relatively easily be ensured with electric drives of the roll stands.

This object is solved by the invention in that a reaction force is measured as the physical parameter on a machine part of the associated stands, preferably on a rolling shaft or rolling-mill drive bearing, and is used for controlling the drive speeds of the electric motors. These reaction forces directly depend on the existing loads, and are thus also a measure for the torques applied in the individual roll stands. Since in addition the roll stands themselves are disposed in the vicinity of the rolling process with respect to the course of the moment of inertia along the line of drive, a change of the torque is detected via the reaction forces of the machine parts of these stands virtually without delay and can lead to a fast control of the rotational speed. It does not play a major role which reaction forces are measured and how they are measured, but it is merely important that no parameters of the electric motor or parameters of the current are used for controlling the rotational speed, but parameters of the roll stand, possibly forces directly influenced by the torque during rolling, where reaction forces in the bearing zones of the rolls and shafts, either axial or radial bearing forces or bearing supporting forces, which can be measured easily and precisely, but also reaction moments in the rolls and shafts themselves, are recommended as preferred parameters.

I claim:

1. A method of controlling the passage of rolling stock through a continuous mill train of successive roll stands comprising rolling shafts supporting the rolls, a rolling-mill drive preceding the rolling shafts, and individual electric motor drives having a steplessly variable rotary speed connected to the rolling-mill drive to apply torque to the rolling shafts, which comprises the steps of (a) measuring a reaction force on a machine part of a respective one of the stands to obtain a physical parameter changing in dependence on the torque before and after an initial pass of a stand succeeding the one stand, and (b) controlling the rotational speed of the individual electric motor drive for the succeeding one stand in dependence on any change of the measured physical parameter.

2. The method of claim 1, wherein the machine part is the rolling shaft.

3. The method of claim 1, wherein the machine part is a rolling-mill drive bearing.

* * * * *